United States Patent [19]

Otomaru

[11] 4,295,843

[45] Oct. 20, 1981

[54] ROTARY DIE CUTTER

[75] Inventor: Tadao Otomaru, Mihara, Japan

[73] Assignee: Mitsubishi Jukogyo Kabushiki Kaisha, Tokyo, Japan

[21] Appl. No.: 108,232

[22] Filed: Dec. 28, 1979

[30] Foreign Application Priority Data

Jan. 8, 1979 [JP] Japan ..... 54-815

[51] Int. Cl.[3] ..... B31B 9/14

[52] U.S. Cl. ..... 493/354; 83/338; 83/347; 83/562; 493/368

[58] Field of Search ..... 83/562, 338, 347, 504, 83/505, 506; 93/58.2; 493/354, 367, 368

[56] References Cited

U.S. PATENT DOCUMENTS

| | | | |
|---|---|---|---|
| 2,400,527 | 5/1946 | Aycock | 83/505 X |
| 3,272,047 | 9/1966 | Ward | 83/338 |
| 4,063,493 | 12/1977 | McEvers | 83/562 |

*Primary Examiner*—J. M. Meister

*Attorney, Agent, or Firm*—Bernard, Rothwell & Brown

[57] ABSTRACT

A rotary die cutter is provided having a knife cylinder, provided on its peripheral surface with a punching blade, and an anvil cylinder around which is wound an anvil against which the punching blade is urged in punching material from cardboard passing between the knife cylinder and the anvil cylinder. The cylinders are driven by meshing gears disposed at the ends of the cylinders and having different numbers of teeth. A pair of helical gears are disposed at one end of the anvil cylinder. One of these helical gears is attached to the anvil cylinder and the other is connected to one of the meshing gears. A mechanism is provided for causing axial movement of the anvil cylinder. This axial movement is converted into rotational movement of the anvil cylinder by the relative movement of the helical gears. As a result, the positional relationship between the punching blade of the knife cylinder and the outer peripheral surface of the anvil cylinder is successively changed to avoid local concentration of the impressions of the punching blade in the anvil surface and thereby to insure longer anvil life.

6 Claims, 9 Drawing Figures

ROTARY DIE CUTTER

BACKGROUND OF THE INVENTION

1. Field of the Invention

This invention relates to rotary die cutters adapted to punch a predetermined shape of cardboard from a cardboard sheet.

2. Description of the Prior Art

A rotary die cutter comprises a knife cylinder and an anvil cylinder which are arranged to oppose each other. The knife cylinder is provided with a punching blade and may also include a scoring blade adapted to score a line on the cardboard sheet. Conventionally the knife cylinder includes material such as plywood covering a portion of the cylinder and the knife, and scoring blade if employed, are mounted in this plywood. The anvil cylinder is usually provided with an outer peripheral surface constituting the anvil which is made of a material such as urethane. Both cylinders are adapted to be driven by means of two gears positioned at one end of each cylinder. In order that the punching blade not engage the same portion of the anvil in successive rotations of the anvil cylinder, the two gears have different numbers of teeth and further means are provided for effecting axial displacement of the anvil cylinder. In operation, as the cardboard sheet is inserted into the space between the two cylinders, the punching blade is driven into the anvil, effecting the punching of the desired shape from the cardboard sheet. In a conventional rotary die cutter impressions generated by the punching blade are not distributed uniformly over the anvil surface and the resultant concentration of damage to the anvil surface shortens the period of use before polishing or renewal of the anvil is required.

By the present invention an improved rotary die cutter is provided which overcomes this deficiency of prior art rotary die cutters and distributes the punching impressions widely over the anvil surface. Thereby the damage to the anvil surface from the punching impressions is not concentrated but is widely dispersed. This results in a longer anvil life and increases the time period which elapses before polishing or renewal of the anvil is required. The invention thus provides for easier maintenance and economy of operation.

SUMMARY OF THE INVENTION

In carrying out the invention, in one form thereof, there is provided a rotary die cutter having a knife cylinder, provided on its peripheral surface with a punching blade, and an anvil cylinder around which is wound an anvil against which the punching blade is urged in punching material from cardboard passing between the knife cylinder and the anvil cylinder. The cylinders are driven by meshing gears disposed at the ends of the cylinders and having different numbers of teeth. A pair of helical gears are disposed at one axial end of the anvil cylinder. One of these helical gears is attached to the anvil cylinder and the other is connected to one of the meshing gears. A mechanism is provided for causing axial movement of the anvil cylinder. This axial movement is converted into rotational movement of the anvil cylinder by the relative movement of the helical gears. As a result, the positional relationship between the punching blade of the knife cylinder and the outer peripheral surface of the anvil cylinder is successively changed to avoid local concentration of the impressions of the punching blade in the anvil surface and thereby to insure longer anvil life.

DESCRIPTION OF THE PREFERRED EMBODIMENTS

Figure 1:
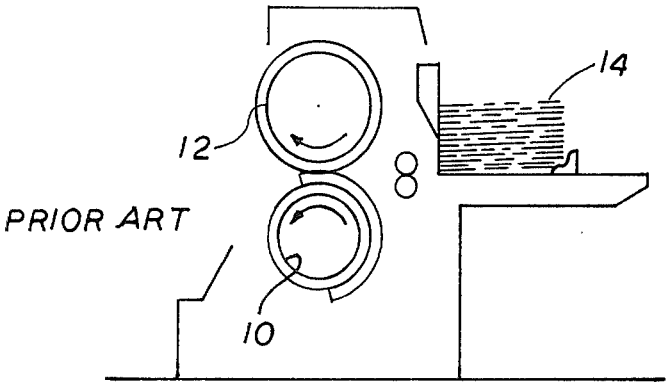
FIG. 1 is a general representation of a rotary die cutter utilized in the prior art for punching material from cardboard sheets.
Figure 2:
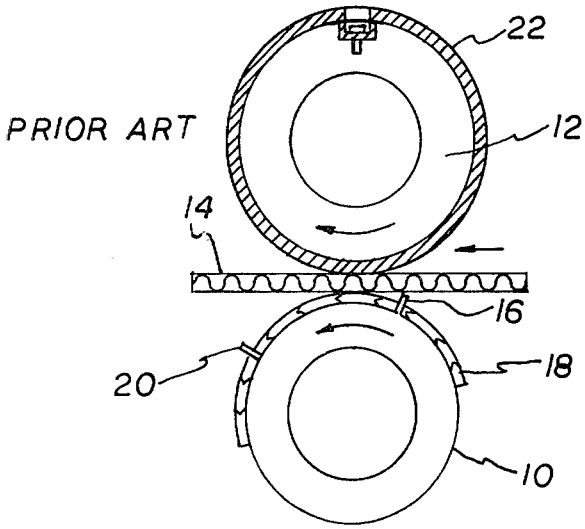
FIG. 2 is a sectional view of the cylinders of FIG. 1 with a cardboard sheet shown in position therebetween.

For a better understanding of the present invention it is helpful at the outset to refer to the operation of conventional rotary die cutters as shown in FIGS. 1 and 2. Referring to FIGS. 1 and 2 there is shown a rotary die cutter which includes a knife cylinder 10 and a cooperating anvil cylinder 12. These cylinders are arranged to receive therebetween cardboard sheets 14 from a stack provided adjacent the rotary die cutter. The knife cylinder 10 is provided with a punching blade 16 which is attached to the cylinder by means of a section 18 of material such as plywood fixed to the exterior surface of the knife cylinder 10. A scoring blade 20 may also be mounted on the cylinder 10 by means of the plywood section. The anvil cylinder 12 is provided on its outer peripheral surface with an anvil 22 which may be made of urethane.

The cylinders 10 and 12 are arranged to be driven by power transmitted through two meshing gears, one gear being attached to one end of the knife cylinder and the other gear being disposed at one end of the anvil cylinder. In order that the punching blade not engage the same portion of the anvil 22 in successive rotations of the cylinders the gears have differing numbers of teeth. In addition, means are provided for effecting axial displacement of the anvil cylinder to distribute the punching impressions lengthwise of the anvil cylinder. In operation, as the cardboard sheet passes between the cylinders the punching blade 16 is driven into the anvil 22 of the anvil cylinder 12, effecting punching of material from the cardboard sheet. If a scoring blade 20 is provided a score line may be also formed in the cardboard sheet.

Figure 3:
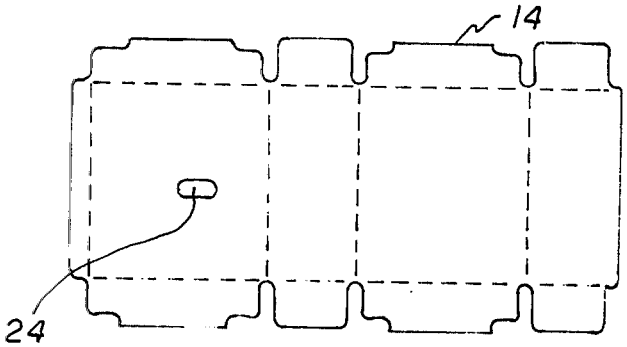
FIG. 3 is a view of a cardboard sheet punched in such apparatus.
Figure 4:
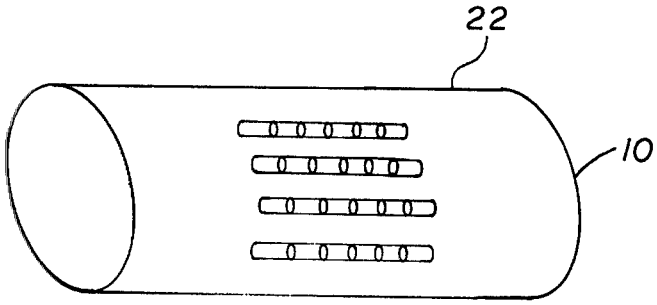
FIG. 4 is a view of an anvil cylinder illustrating the impressions made thereon by the punching blade in prior art apparatus.

An example of a cardboard sheet 14 after the punching of a hole therein by the rotary die cutter is shown in FIG. 3. Impressions formed in the anvil 22 after repeated punching of holes 24 in cardboard sheets are illustrated in FIG. 4.

As seen from these figures, in a conventional rotary die cutter impressions resulting from the forcing of the punching blade against the anvil are not distributed uniformly over the anvil. This causes concentrated wear in these areas of the anvil engaged by the punching blade and results in a need to polish or renew the anvil before the entire surface thereof has been utilized.

This limitation of the prior art is avoided by the rotary die cutter of the present invention and the impressions made by the punching blade are widely distributed so as to utilize substantially all of the anvil surface. This results in a more nearly uniform wear, thereby lengthening the period of use of the anvil before it must be polished or renewed.

Figure 5:
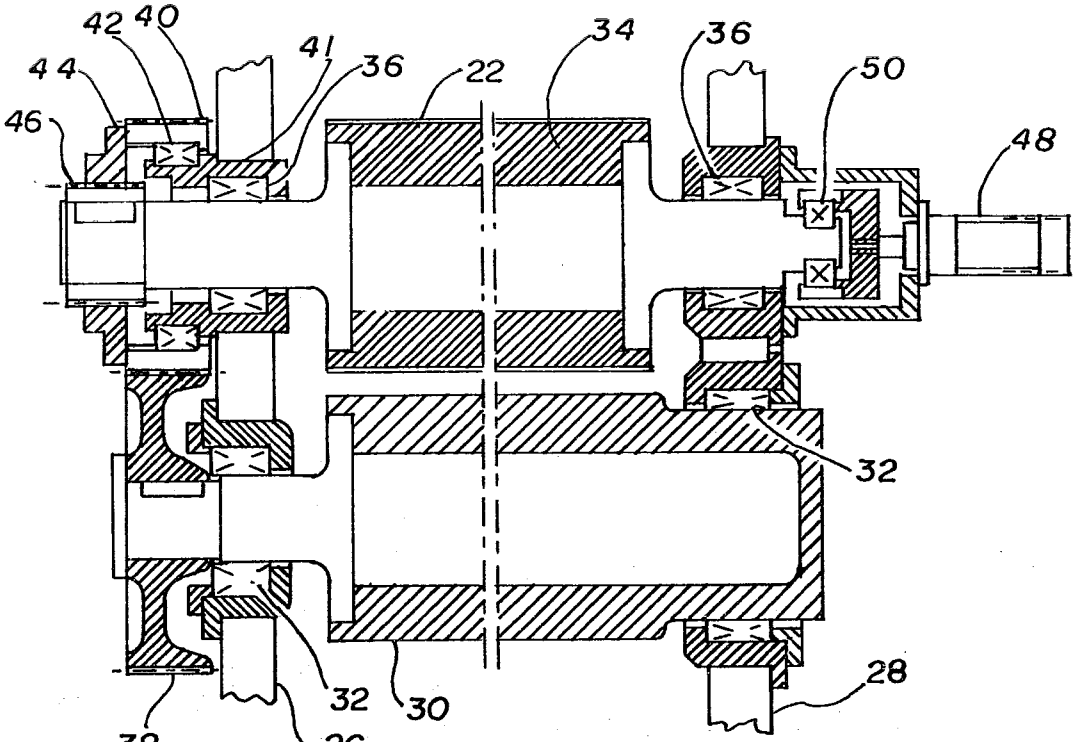
FIG. 5 is a sectional view of one embodiment of the present invention.
Figure 6:
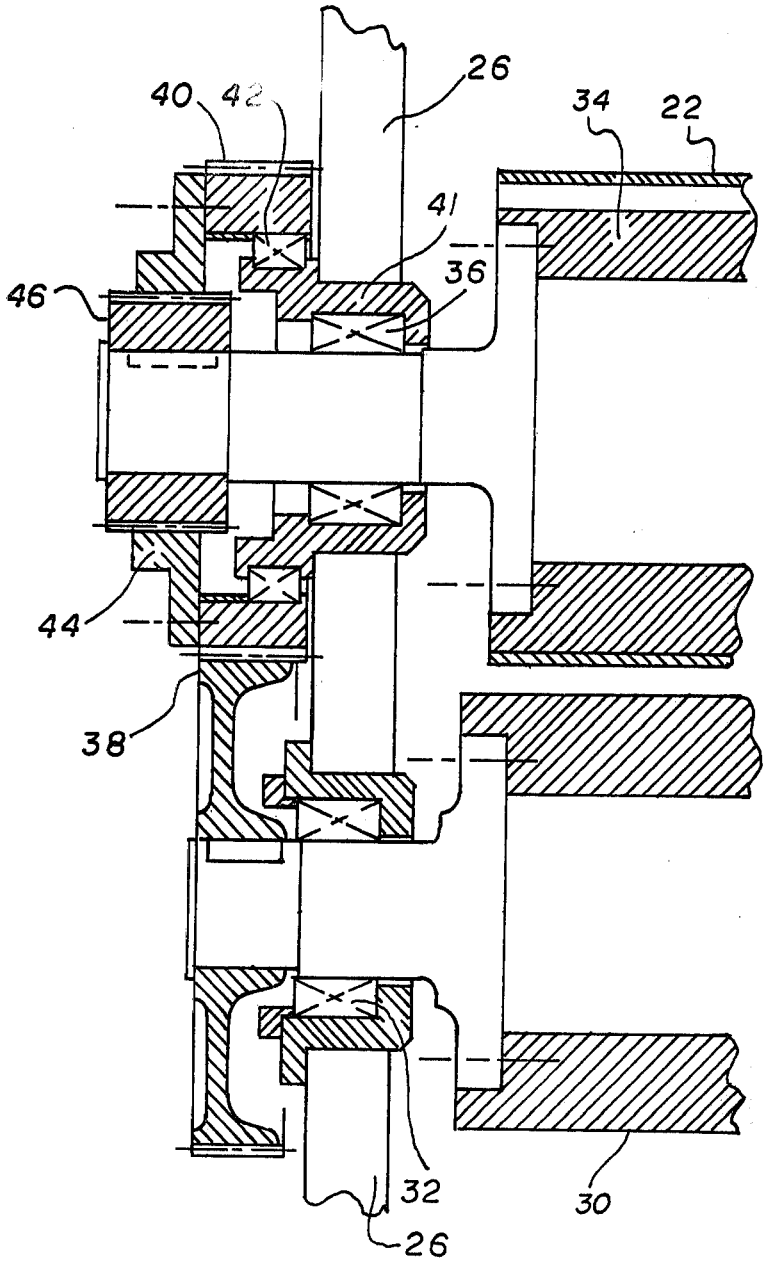
FIG. 6 is an enlarged view of a portion of FIG. 5, showing details of the present invention.

Referring now to FIGS. 5 and 6, which illustrate a first embodiment of this invention, there is shown a rotary die cutter which includes supporting frame members 26 and 28. A knife cylinder 30 is mounted for rotation in the frame members 26, 28 by means of bearings 32 and anvil cylinder 34 is also mounted for rotation in the frame members 26, 28. The anvil cylinder 34 is supported for rotational movement in the frame members by means of bearings 36. A gear 38, which may be driven from any suitable driving means, if fixed to one end of the knife cylinder 30. A second gear 40, which is adapted to be driven from the gear 38, is supported for rotation on a bearing structure 41 of the bearing 36 by means of a bearing 42. In the embodiment shown the meshing gears 38 and 40 are spur gears.

To effect rotation of the anvil cylinder 12 from the gear 38, and also to effect adjustment of the position of the anvil cylinder relative to a punching blade (not shown in FIG. 5 and 6) in a manner to be described later, a helical gear 44 is fixed to the gear 40. A helical gear 46, which is arranged to mesh with helical gear 44, is fixed to one end of anvil cylinder 34 by a key or other suitable attaching means. As shown in FIGS. 5 and 6 the helical gear 46 has a greater width than the helical gear 44 so as to accommodate axial movement of the gear 46 relative to the gear 44 during axial movement of the anvil cylinder 34. The difference in width is preferably at least equal to the amount of axial movement of the anvil cylinder so that the helical gears remain in engagement throughout the axial movement of the anvil cylinder. Alternatively, the helical gears could be arranged for such relative axial movement by making the gear 44 of greater width than the gear 46.

In order to provide for axial movement of the anvil cylinder 34 a suitable actuating mechanism 48 is provided. This actuating mechanism may be, for example, any conventional fluid pressure operated device which may be mounted in any suitable manner on the frame member 28 and is connected to the anvil cylinder 34 through a bearing 50. This connection through the bearing 50 provides for rotation of the anvil cylinder 34 relative to the actuating mechanism while at the same time providing for axial movement of the anvil cylinder.

The operation of this embodiment of the invention is as follows. Driving power is transmitted to the gear 38 to rotate the knife cylinder 10. Power is transmitted to the anvil cylinder 12 from the gear 38 through the gear 40 and the meshing helical gears 44 and 46 to rotate the anvil cylinder 34. Meanwhile, as the actuating mechanism 48 is energized, the anvil cylinder 34 is moved in an axial direction. This not only moves the anvil cylinder longitudinally to vary the position of engagement of the punching blade 16 with the anvil 22 but, in accordance with this invention, it also moves the helical gear 46 longitudinally relative to the helical gear 44. This relative movement of the helical gears causes a rotational shift in the position of the anvil cylinder 34 so that the position of the impression imparted to the anvil by the punching blade is shifted obliquely relative to the anvil. This shift in successive impressions 51 made by the punching blade is shown in FIG. 7.

Figure 7:
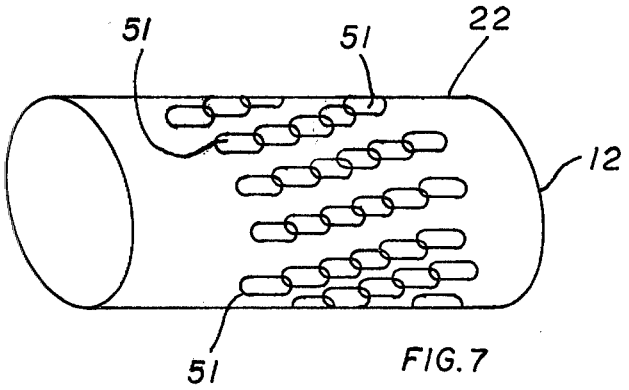
FIG. 7 is an illustration of impressions formed in the anvil by the punching blade of the rotary die cutter shown in FIGS. 5 and 6 during punching of cardboard.

As described above, by the present invention the anvil cylinder 34 is displaced in both an axial and a circumferential direction so that successive impressions by the punching blade are made along an oblique line as shown in FIG. 7. Consequently, the overlapping of the impressions is reduced, compared to that shown in FIG. 4, and the wear on the anvil surface is made more uniform. Further, the depth of the driving of the punching blade into the anvil surface is made more uniform over the entire surface of the anvil, thereby stabilizing the cutting performance of the punching blade and improving the precision of the punching of the cardboard sheet.

Figure 8:
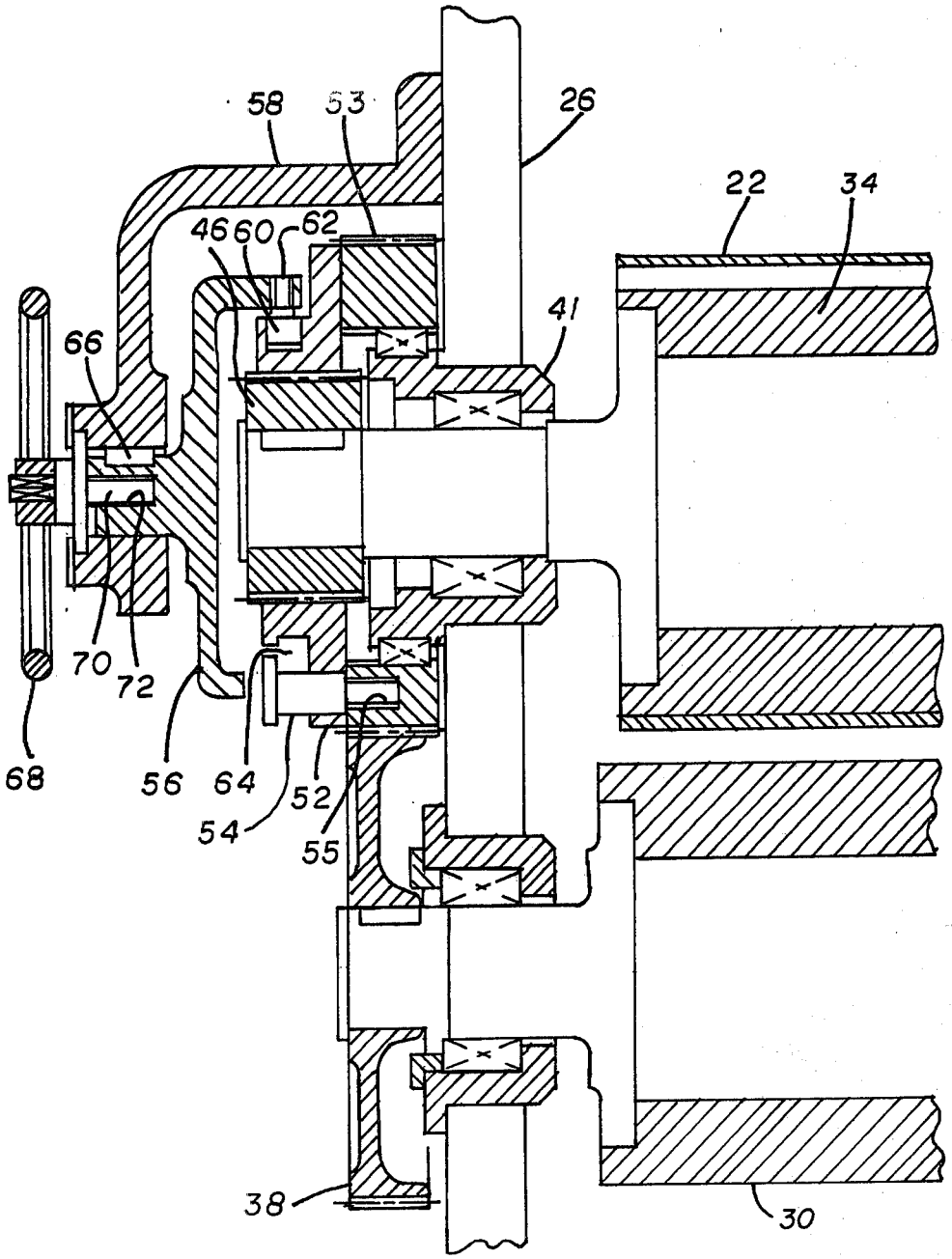
FIG. 8 is a view similar to FIG. 5 showing a second embodiment of the invention.

Referring now to FIG. 8 there is shown a second embodiment of this invention which provides further improved performance, more complete distribution of the punching blade impressions over the anvil and even longer life of the anvil before renewal is required. The same numerals have been employed to designate corresponding parts in this embodiment and in the first embodiment shown in FIGS. 5 and 6. In the embodiment of FIG. 8 a helical gear 52, which corresponds generally to the helical gear 44 in the first embodiment, is connected to a gear 53, which corresponds to the gear 40 of the first embodiment, in a manner which permits adjustment thereof in a longitudinal direction relative to the helical gear 46. A pin 54 is mounted in a recess 55 in the helical gear 52 for connecting the helical gear 52 with the gear 53 for insuring rotational movement therewith while still permitting longitudinal movement relative thereto. Phase adjusting means, including a phase adjusting member 56, is provided for effecting movement of the helical gear to provide a further rotational shift of the anvil cylinder 34. This phase adjusting member 56 is supported from the frame member 26 by means of a supporting arm 58. A roller 60 is mounted by means of a bearing 62 on the upper portion of the phase adjusting member 56. The roller 60 is received within a circumferential groove 64 formed in the peripheral surface of the helical gear 52 so as to permit rotation of the helical gear 52 relative to the phase adjusting member 56 while at the same time providing for movement of the helical gear 52 in an axial direction by means of the phase adjusting member 56. The phase adjusting member 56 is mounted on the arm 58 for axial movement but is prevented from rotational movement by means of a key 66 which engages cooperating slots in the phase adjusting member 56 and the arm 58. In order to effect axial movement of the phase adjusting member 56, and thereby axial shifting of the helical gear 52, an adjusting handle 68 is provided. The handle 68 includes a shaft 70 received in a recess 72 in the phase adjusting member 56. The handle 68 is arranged in screw-threaded relationship with the arm 58 so that turning of the handle causes axial movement of the phase adjusting member 56. Because of the engagement of the roller 60 with the groove 64 this axial movement of the phase adjusting member 56 effects a corresponding axial movement of the helical gear 52 and changes the relationship of the helical gear 52 and the helical gear 46.

The second embodiment of this invention shown in FIG. 8 operates in the following manner. After the punching of a predetermined number of cardboard sheets utilizing the adjusting arrangement previously described in connection with FIGS. 5 and 6, the handle 68 is rotated by a predetermined amount so that the phase adjusting member 56 is moved in the axial direction of the anvil cylinder 34. This movement of the phase adjusting member 56 is transmitted to the helical gear 52 through the roller 60 to cause the helical gear 52 to move in the same direction by the same amount. As a result, the phase of the rotation of the helical gear 52 relative to the helical gear 46 is changed and a rotational shift of the anvil cylinder 34 is effected.

Figure 9:
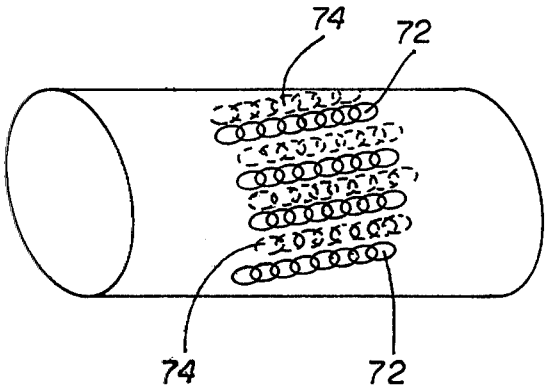
FIG. 9 is an illustration of impressions formed on the anvil of the rotary die cutter of the second embodiment.

The effect of this change on the operation of the rotary die cutter is illustrated in FIG. 9. The solid line impressions 72 there shown correspond to the impressions shown in FIG. 7 at 51. With the rotational shift effected by the phase adjusting member 56 the line of impressions in subsequent operation of the rotary die cutter is illustrated by the broken lines indicated by the numeral 74 in FIG. 9. Thus, in the second embodiment, it is possible to infinitely change the position of the anvil relative to the punching blade by the simple manipulation of the handle to effect the further adjustment described above and thereby to further enhance the advantages of the first embodiment of this invention. It can be appreciated by reference to FIG. 9 that by this second embodiment the punching impressions are distributed more widely over the surface of the anvil cylinder so that that surface is more fully utilized and the period of time between polishing or renewal of the anvil surface is further increased.

It is claimed:

1. A rotary die cutter comprising:

(a) a knife cylinder having a punching blade on its peripheral surface;

(b) an anvil cylinder positioned adjacent said knife cylinder and arranged to be engaged by said blade for punching a cardboard sheet passing between said cylinders;

(c) first and second meshing gears for driving said cylinders, said first gear being arranged at one end of said knife cylinder and said second gear being arranged at one end of said anvil cylinder;

(d) first and second interengaging helical gears disposed at said one end of said anvil cylinder, said first helical gear being mounted on said anvil cylinder, said second helical gear being connected to said second meshing gear;

(e) mechanism engaging said anvil cylinder for moving said anvil cylinder axially;

(f) said axial movement of said anvil cylinder causing relative axial movement of said helical gears to impart a rotational shift to said anvil cylinder; and (g) adjusting means engaging one of said helical gears to move said one of said helical gears axially for imparting a further rotational shift to said anvil cylinder.

2. The rotary die cutter of claim 1 wherein said one of said helical gears is said second helical gear.

3. The rotary cutter of claim 2 and further including:

(a) a circumferential groove in the periphery of said second helical gear;

(b) said adjusting means including a projecting member received in said groove for effecting axial movement of said second helical gear.

4. The rotary die cutter of claim 3 and further including a stationary arm; and wherein said adjusting means includes an adjusting member supported on said arm and having a bearing therein, and said projecting member is a roller mounted in said bearing.

5. The rotary die cutter of claim 4 wherein:

(a) said second meshing gear has a recess therein; and (b) said second helical gear includes a pin extending therethrough and received in said recess for permitting relative axial movement of said second helical gear and said second meshing gear but connecting said second meshing gear in rotational driving engagement with said second helical gear.

6. The rotary die cutter of claim 2 wherein said adjusting means includes:

(a) a stationary arm;

(b) an adjusting member supported by said arm;

(c) a rotatable adjusting element mounted in screwthreaded relationship with said stationary arm and engaging said adjusting member whereby rotation of said adjusting element effects axial movement of said adjusting member to move said second helical gear.

* * * * *